United States Patent [19]

Wakimoto

[11] 4,184,711

[45] Jan. 22, 1980

[54] FOLDING CANVAS CHAIR

[76] Inventor: Yasuo Wakimoto, No. 3-6, Nishiasakusa 1-chome, Taito-ku, Tokyo, Japan

[21] Appl. No.: 950,712

[22] Filed: Oct. 12, 1978

[30] Foreign Application Priority Data

Oct. 14, 1977 [JP] Japan ..... 52/136750[U]

[51] Int. Cl.[2] ..... A47C 4/00

[52] U.S. Cl. ..... 297/16; 297/379; 108/118; 248/164

[58] Field of Search ..... 297/16, 18, 379, 441; 248/164, 431, 432

[56] References Cited

U.S. PATENT DOCUMENTS

| | | | |
|---|---|---|---|
| 40,208 | 10/1863 | Abbott | 297/18 |
| 1,845,921 | 2/1936 | Karwoski | 248/164 X |
| 2,352,090 | 6/1944 | Faller | 108/118 X |
| 2,360,231 | 10/1944 | Horton | 108/118 X |
| 2,400,630 | 5/1946 | Cramer et al. | 297/379 |
| 2,402,832 | 6/1946 | Muller | 297/379 |
| 3,514,155 | 5/1970 | Close | 297/379 |

FOREIGN PATENT DOCUMENTS

| | | | |
|---|---|---|---|
| 514306 | 10/1952 | Belgium | 297/16 |

*Primary Examiner*—Ramon S. Britts
*Assistant Examiner*—Peter A. Aschenbrenner
*Attorney, Agent, or Firm*—Darby & Darby

[57] ABSTRACT

A folding canvas chair provided with four rods, each of which serves at the lower half thereof as a leg of the chair, while at the upper half thereof as a supporting post for stretching a canvas sheet between adjacent posts, the lower end of said post is fastened to the upright end of a metal connecting member, while the top end of said rod is pivotally coupled with said connecting member at the lower end thereof, and a basic framework plate having four apertures thereon for permitting corresponding leg to pass therethrough to be pivotally secured to said plate.

1 Claim, 4 Drawing Figures

FOLDING CANVAS CHAIR

BACKGROUND OF THE INVENTION

The present invention relates to a folding canvas chair and, in particular, relates to a folding and unfolding mechanism of said folding chair to be fitted to a supporting post which is adapted to bear against the leaning force loaded on a canvas back sheet stretched between said supporting posts located adjacent to each other.

Conventional folding canvas chair is defectively constructed to form rather a bulky shape in volume after folded accompanying a pretty troublesome procedure in handling said chair in the course of folding and unfolding operation by utilizing merely a hing and pivotal coupling mechanism.

SUMMARY OF THE INVENTION

The present invention is aimed at to provide an improved mechanism for folding and unfolding rods constituting a framework of a folding canvas chair, each of said rods is serviceable at the upper half thereof as a supporting post for stretching a canvas back sheet between said two supporting posts located adjacent to each other while at the lower half thereof as a leg of the chair, and said supporting post is adapted to fall down easily and to be raised up by a metal connecting member fitted at the upright end thereof to the lower end of said supporting post, while at the lower end of said connecting member is pivotally coupled with the upper end of said leg, and a strip-like leaf spring is securely fitted at the upper end thereof to the front surface near the lower end of said supporting post, and said leaf spring is provided at the lower extension thereof with a curved hook portion which is adapted to pass through a slot formed on the upper part of said rod to be protruded from the lower side of said rod so as to be in contact with a flange of said slot.

Due to the above-mentioned mechanism provided on the framework structure of a folding chair according to the present invention, said supporting posts for stretching a canvas back sheet between adjacently disposed posts afford a very comfortable mood when a person is seated on the chair having a leaning back portion supported by said adjacently disposed posts, and said mechanism is effective for carrying out folding action of said support-posts in which, in case of said chair being folded, the chair is folded in compact size as possible with smart appearance followed by no troublesome handling in said folding action.

BRIEF DESCRIPTION OF THE DRAWINGS

The attached drawings show a folding canvas chair in a form of an embodiment of the present invention, in which.

DESCRIPTION OF THE PREFERRED EMBODIMENTS

Figure 1:
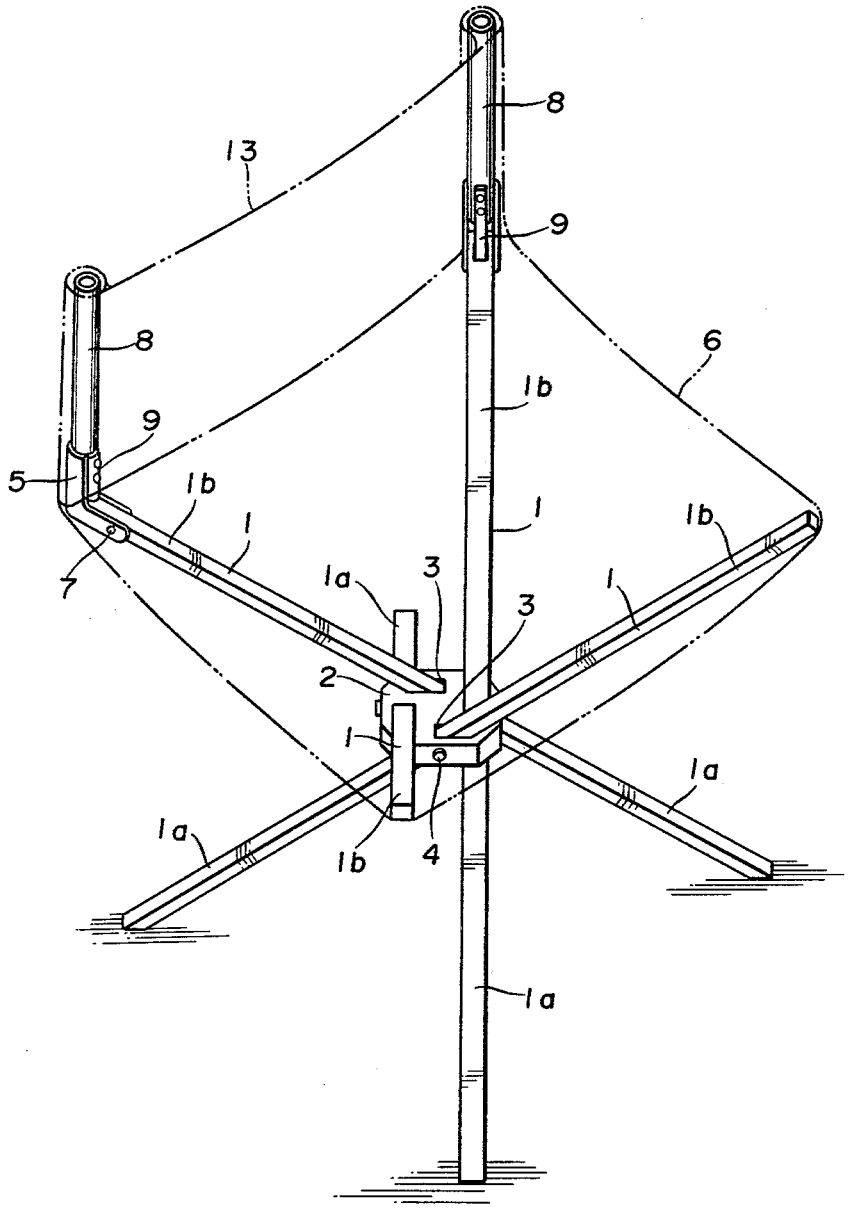
FIG. 1 is a perspective view of the whole body of a set-up folding chair.
Figure 2:
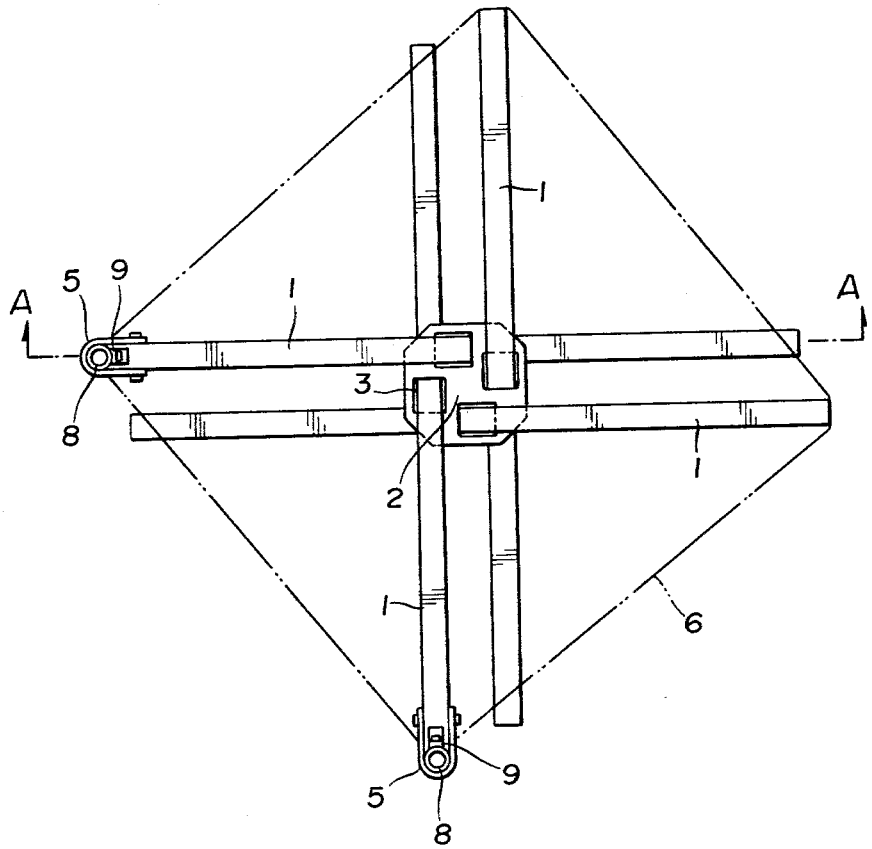
FIG. 2 is a plan view of the above same.
Figure 3:
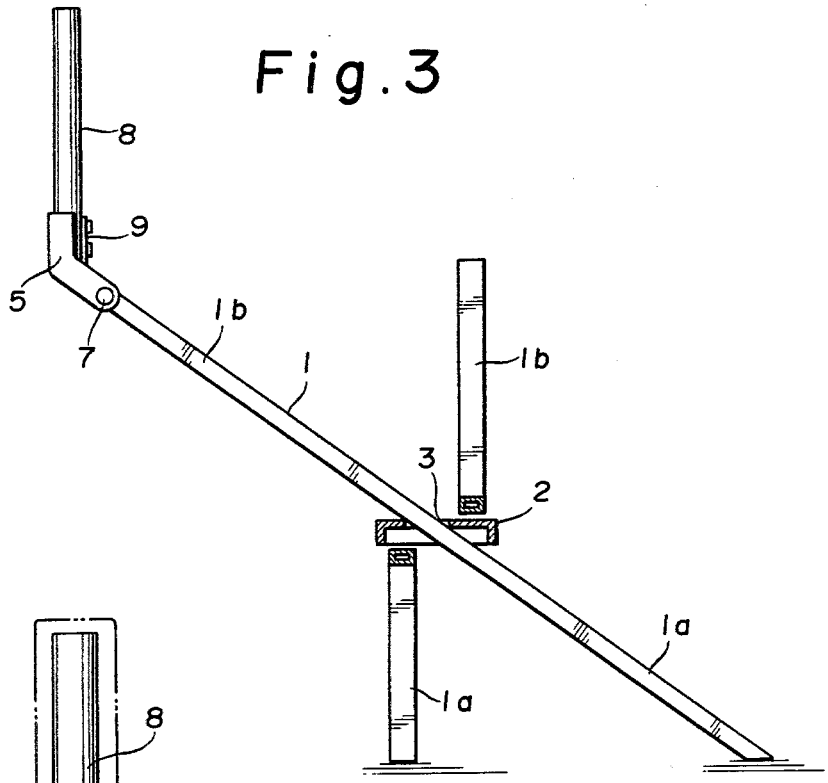
FIG. 3 is a sectional view taken along the line A—A of FIG. 2.

The present invention will now be explained in detail with reference to the drawings by way of example in a form of embodiment of the invention.

In the drawings, the reference numeral 1 represents four rods for setting up a framework of a chair according to the present invention, and each of said rods is adapted to serve at the lower half thereof as a leg 1*a* for supporting a seat of the chair, while at the upper half thereof as a post 1*b* for supporting a canvas sheet to be stretched between said two posts, 2 designates a basic framework plate having four apertures 3 perforated at four predetermined positions thereon for inserting each of said rod to be passed therethrough respectively. Each of said rods is pivotally secured at a predetermined position thereof to a flange of said respective aperture by a pivotal pin 4 so as to be swingingly connected with said basic framework plate 2, and 5 denotes a metal connecting member of a L-shape in profile having a forked portion at the lower end thereof for carrying therein the top end of each rod 1 disposed on both sides of a seat 6 in the rear part thereof so as to fix said rod 1 pivotally by a pivot pin 7, while within the upright end of said connecting member 5 is inserted securely a supporting rod 8 having a necessary length at the lower end thereof, 9 is a strip-like leaf spring screwed at the upper end thereof to be fitted to the front surface adjacent to the lower end of said supporting rod 8, and said leaf spring 9 is formed at the lower end thereof in a curved hook portion 10 which is adapted to pass through a slot 11 provided on the upper end portion of said rod 1 to be protruded from the lower side of said rod 1, and said curved hook portion 10 is also adapted to be engaged with the flange 12 formed on the aperture 11 at the upper end thereof, thus with the foregoing structure, a canvas sheet 13 is spread between two supporting posts 8 for supporting of the back of a person seated on the chair who is leaning against said canvas sheet 13.

The function of the folding canvas chair according to the present invention will be set forth hereinafter.

Figure 4:
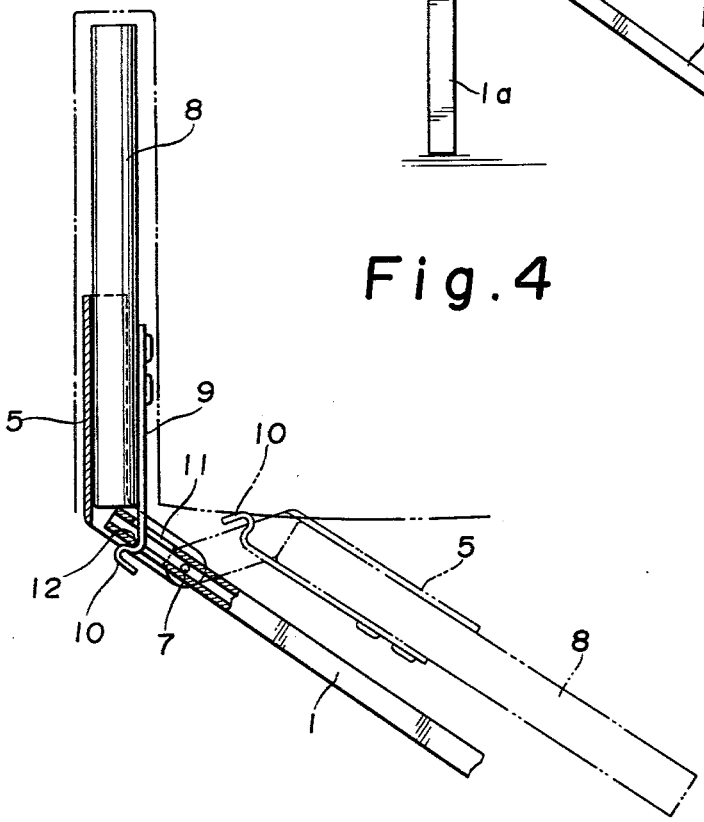
FIG. 4 is a side view of the chair at the legs thereof forming a framework showing the essential part of the leg in an enlarged scale.

Since the present inventive chair is set up in the structure mentioned above, when the supporting post 8 is subjected to be folded to a position indicated by the chain-dotted line as shown in FIG. 4, the curved hook portion 10 provided on the lower end of said leaf spring 9 is displaced manually along the inner part of the slot 11 so as to be released the engagement with said flang 12 of said slot 11, thereby the supporting post 8 can easily be folded. On the other hand, in case of unfolding said supporting post 8 once having been folded, said folded post 8 can facilely be raised upward by lifting up said post with the aid of manual force, since the L-shape connecting member 5 is pivotally secured to said rod 1 by the pivot pin 7, and at the same time the curved hook portion 10 formed at the lower end of the leaf spring is adapted to be engaged within the slot 11 as well as to be in contact with the flange provided on the upper end portion of said slot 11 as is indicated by the solid line in FIG. 4 so as to stabilize the raising-up motion of the supporting post 8, thus said supporting posts are able to bear against the leaning force loaded on the canvas back sheet 13 without falling backward as well as to stand fast steadily.

According to the present invention as having elucidated hereinbefore, when a person sits down on the seat of a chair set up by spreading the canvas back sheet 13 between said raised-up supporting posts 8, said chair surely afford an extremely comfortable mood to him as for a folding canvas chair, moreover, when said chair is folded, said supporting posts are adapted to fall down along the rod 1 to be readily folded as set forth above concurrently to be, in particular, kept from becoming bulky in volume after folded. Therefore, it is very convenient for handling a folding and unfolding operation as well as for portability of the folding chair can afford a highly comfortable mood when actually used in unfolded state.

What is claimed is:

1. A canvas chair which is constructed to be readily capable of folding and unfolding as well as provided with four rods 1 for setting up a framework of a chair, the lower half portion of said rod 1 being serviceable as a supporting leg while the upper half portion of said rod 1 being used as a supporting post for a canvas back sheet to be spread over between said two supporting posts, and said rod 1 being inserted through an aperture 3 perforated on a basic framework plate 2 to be pivotally secured to said basic framework plate at a predetermined spot located in the center part of each rod 1, said folding canvas chair characterized in comprising metal connecting members 5 of a L-shape in profile having a forked portion formed at the lower end thereof, said forked portion being pivotally connected with the upper end at both sides of said rod 1 disposed at the right and left sides in the rear of a seat 6, while said forked portion at the upper end thereof being securely fixed to the lower end of said supporting post 8 having a desired length so as to swing said supporting post upward and downward, a strip-like leaf spring having a necessary length provided on the front surface adjacent to the lower end of each of said supporting posts, said leaf spring being fitted securely to said supporting post 8 at the upper end thereof and having a curved hook portion 10 formed on the lower extension thereof to pass through a slot 11 perforated on the upper end portion of said rod 1 so as to protrude from the lower side of said rod 1 as well as to be in contact with a flange of said slot 11 formed on the upper end portion thereof, and a canvas back sheet 13 being spread over between said two supporting posts 8 which are located on both sides of the seat 6 to be inserted into both hemmed edges of said back sheet 13.

* * * * *